US006643896B2

(12) United States Patent
Carrier

(10) Patent No.: US 6,643,896 B2
(45) Date of Patent: Nov. 11, 2003

(54) ADJUSTABLE HINGE

(76) Inventor: Germain Carrier, 124 de la Colline, St-Lambert-de-Levis, Quebec (CA), G0S 2W0

( * ) Notice: Subject to any disclaimer, the term of this patent is extended or adjusted under 35 U.S.C. 154(b) by 121 days.

(21) Appl. No.: 10/056,260

(22) Filed: Jan. 11, 2002

(65) Prior Publication Data

US 2002/0108212 A1 Aug. 15, 2002

(30) Foreign Application Priority Data

Jan. 26, 2001 (CA) ..... 2332484

(51) Int. Cl.[7] ..... E05D 7/04

(52) U.S. Cl. ..... 16/242; 16/235; 16/362; 16/366; 49/248; 49/345

(58) Field of Search ..... 16/235, 236, 242, 16/244, 245, 362, 239, 366, DIG. 34, DIG. 39; 49/252, 246, 250, 345, 248

(56) References Cited

U.S. PATENT DOCUMENTS 1,336,174 A * 4/1920 Way ..... 16/242
4,726,092 A * 2/1988 Tacheny et al. ..... 16/364
RE32,846 E * 1/1989 Sandberg et al. ..... 16/381
5,074,075 A * 12/1991 La See ..... 49/252
5,307,539 A * 5/1994 Bauman ..... 16/239
RE35,635 E * 10/1997 Bauman ..... 16/239
6,134,751 A * 10/2000 Carrier et al. ..... 16/242
6,513,194 B2 * 2/2003 Harkins et al. ..... 16/239

FOREIGN PATENT DOCUMENTS

GB 2258491 A * 2/1993

* cited by examiner

*Primary Examiner*—Anthony Knight
*Assistant Examiner*—André L. Jackson
(74) *Attorney, Agent, or Firm*—Eric Fincham

(57) ABSTRACT

There is provided an improved connecting member for use in connecting a sash support arm and a sash arm in a hinge assembly for a casement window, the connecting member having a cylindrical stud portion which extends through a sash arm cylindrical aperture and a cylindrical shaft extending from the cylindrical stud portion, the cylindrical shaft being eccentric with respect to the stud portion and extending through to a sash support arm opening, the cylindrical shaft having a recess formed therein designed to receive a tool to prevent rotational movement of the connecting member to thereby permit change of a sash support arm pivot axis.

5 Claims, 1 Drawing Sheet

ADJUSTABLE HINGE

FIELD OF THE INVENTION

The present invention relates to casement hinges for windows and more particularly towards improved track pivots of casement hinges.

BACKGROUND OF THE INVENTION

The casement window has a window sash moveably mounted within a frame by a pair of hinges mounted between the window frame and the top of the window sash. It is typical that such a hinge has a track moveable relative to the window and a sash arm connectable thereto. A support arm extends between the sash and the sash arm. The support arm interconnects the track and the sash arm, with the support arm being pivotably connected to the sash arm and to the track. The sash arm is, in turn, pivotably connected to a mounting shoe which is supported and guided for movement lengthwise of the track.

A variation of the hinge includes an intervening link between the sash arm and the moveable shoe to provide for an offset sash arm. Such hinge typically include a separate intervening link between the support arm and the moveable shoe to provide further support.

When window hinges of the above type are installed, proper operation and sealing of the window requires that the fixed track pivot, which is usually between the support arm and the window frame, be properly located relative to the window sash. Over the life of the window, the proper location of the fixed track pivot may change to slight shifting of the window, window frame, etc. resulting in a sag in the sash. Sash sag is a condition formed when the sash and the frame of the window are not longer square to each other when in the closed position, or the edge of the sash which is opposite the hinges seems to sag in comparison to the frame of the window. As a result, the window may not seal tightly or even open and close properly.

A solution to the above has usually required that the hinge track be provided with slotted holes and the hinge mounting screws in the slotted holes be removed to allow for shifting of the track. However, repeated removal of the screws can result in gradual loosening of the strength of the mounting. Furthermore, settling of the frame to properly position the window sash can necessitate that the window be first opened to allow access to the hinge for adjustment and then closed to check for sash alignment.

It has been proposed in the art to provide for a connection for adjustable holdings two window hardware members together. Such an arrangement is shown in U.S. Re-Issue Pat. No. 35,635. In this arrangement, there is provided a pivot adjustment for the connection between the sash support arm and the track which includes a eccentric shaft to thereby provide means for adjusting the connection.

The means for adjusting the connection require the use of a wrench. This reference also does not teach the ability to adjust the connection between the sash support arm and the sash arm.

SUMMARY OF THE INVENTION

It is an object of the present invention to provide a simple and easily adjustable connection between the sash and sash support arm.

According to one aspect of the present invention, there is provided an improvement in a hinge assembly suitable for use in a casement window wherein the hinge assembly includes a track, a sash arm having a first sash arm end connected to the track and a second sash arm end connected to the casement window, and a sash support arm having a first sash support arm end pivotably connected to the track and a second sash support arm end pivotably connected to the sash arm, the improvement wherein the second sash support arm is connected to the sash arm by a connecting member, and wherein the connecting member is connected through a sash arm aperture and a sash support arm aperture, the improvement wherein the connecting member comprises a cylindrical stud portion having a first stud end and a second stud end, the stud portion extending through the sash arm cylindrical aperture, a cylindrical shaft connected to the second stud end, the cylindrical shaft extending through the sash support arm cylindrical opening, the cylindrical shaft being eccentric with respect to the stud portion, and a recess formed in a free end of the cylindrical shaft, the recess being designed to receive a tool to permit rotational movement of the connecting member to thereby permit change of a sash support arm pivot axis.

In a preferred embodiment of the present invention, there is also provided an arrangement for adjusting the length of the sash arm. In this embodiment, there is provided an arrangement wherein the sash support arm has a first arm segment and a second arm segment, the first arm segment having a first arm segment first end and a first arm segment second end, the second arm segment having a second arm segment first end and a second arm segment second end, the first arm segment first end being pivotably connected to the sash arm and the second arm segment second end being pivotably connected to the track, the first arm segment second end, the second arm segment first end being in an overlying co-planar relationship, with means for securing the first arm segment and the second arm segment, together in an adjustable manner adjacent the first arm segment second end and the second arm segment first end.

In the preferred embodiment, the means for securing the first arm segment and the second arm segment together comprise a threaded aperture formed in one of the arm segments, and a slot formed in the other of the arm segments with a machine screw threadedly engaged with the treaded aperture. Preferably, the threaded aperture is formed in the first arm segment and the slot is formed in the second arm segment.

Also, in a preferred embodiment, there is provided a second slot formed in the second arm segment and a guide member formed in the first arm segment.

BRIEF DESCRIPTION OF THE DRAWINGS

Having thus generally discussed the invention, reference will be made to the accompanying drawings illustrating an embodiment thereof, in which.

DESCRIPTION OF THE PREFERRED EMBODIMENTS

Figure 1:
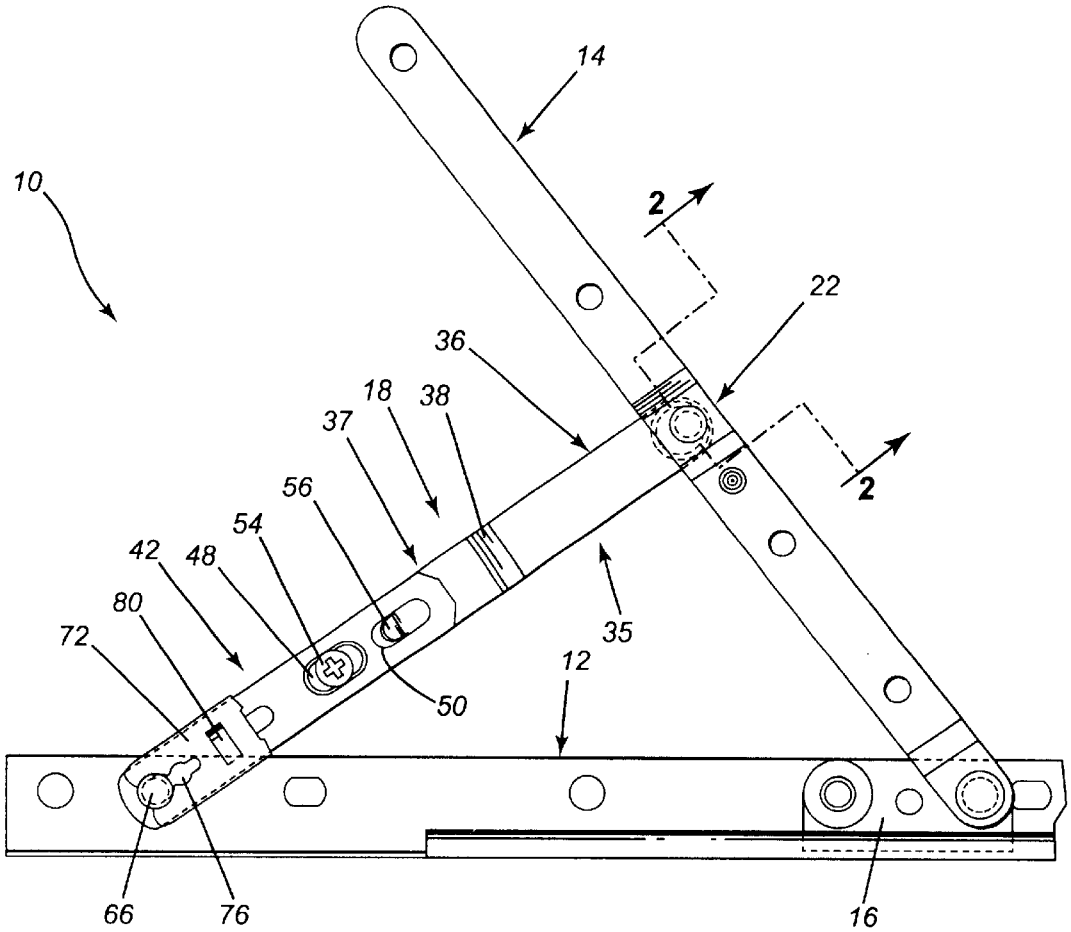
FIG. 1 is a top plan view of an adjustable hinge for a casement window.
Figure 2:
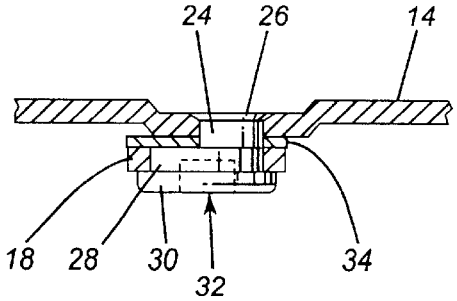
FIG. 2 is a cross sectional view of the adjustment point using an eccentric rivet.
Figure 3:
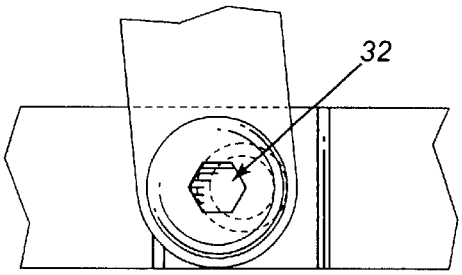
FIG. 3 is a bottom plan view thereof.

Referring to the drawings in greater detail by reference characters thereto, there is illustrated in FIG. 1 an adjustable hinge assembly which is generally designated by reference numeral 10.

Adjustable hinge assembly 10 includes a track 12. A sash arm 14 is pivotably connected to shoe 16 which rides in track 12. A support arm 18 is also pivotably connected to sash arm 14 at point 22 and at the other end to track 12. The above arrangement is a substantially conventional one known to those skilled in the art.

According to the present invention, there is provided a connection which is generally designated by reference numeral 22. Connection 22 includes a member having a shaft 24 extending through an aperture in sash arm 14. Shaft 24 has an enlarged head 26 which abuts the edge of sash arm 14.

Connection 22 is also provided with a eccentric portion 28 at the other end of shaft 24. Eccentric portion 28 is designed to fit within an aperture in support arm 18.

Finally eccentric portion 28 has a head 30 formed at the end thereof and which engages the underside of support arm 18. Formed within head 30 is a recess 32 sized to receive an adjustment to which, in the illustrated embodiment, may comprise an Allen key or other means for turning the connection and thus, due to the eccentric portion 28, changing the point of pivot of support arm 18.

The arrangement is such that when any sag is detected in the supported window sash, it may be simply corrected by turning eccentric portion 28 to effectively move the pivot point. Once the eccentric portion has been turned, frictional forces will secure the connector against further movement.

Sash support arm 18 has a first support arm segment 35 which has a first end 36 and a second end 37 with a transition section 38 therebetween.

A second sash support arm segment 42 also forms a portion of sash support arm 18. A first end of second sash support arm 42 has a pair of slots 48 and 50 formed therein.

Second end 37 of first sash support arm segment 35 underlies the first end of second sash support arm segment 42 while being in a co-planar relationship. A screw 54 screw threadedly engageable with a threaded aperture in second end 37 of first sash support arm segment 35 permits adjustment of the overall length of sash support arm 18. Also formed on second end 37 of first sash support arm 35 is a guide member 56 which is slidably engageable within slot 50 in which guide member is formed by punching upwardly a portion of the material of first support arm segment 35.

Second end 46 of second sash support arm segment 42 is formed with an aperture and is pivotably connected to track 12 by means of a stud 66. A retaining clip 72 is slidable along second support arm segment 42 by use of U-shaped side walls. A slot 76 formed in retaining clip 72 has circular outlines which are designed to engage a groove on stud 66. A raised portion 80 on retaining clip 72 facilitates the movement thereof.

Tightening of screw 54 can be accomplished by a standard screwdriver to thereby commit adjustment of the total length of support arm 18.

It will be understood that the above described embodiments are for purposes of illustration and that changes or modifications may be made thereto without departing from the spirit and scope of the invention.

I claim:

1. In a hinge assembly suitable for use in a casement window wherein said hinge assembly includes a track, a sash arm having a first sash arm end connected to said track and a second sash arm end connected to said casement window, and a sash support arm having a first sash support arm end pivotably connected to said track and a second sash support arm end pivotably connected to said sash arm, the improvement wherein said second sash support arm end is connected to said sash arm by a connecting member, and wherein said connecting member is connected through a sash arm aperture and a sash support arm aperture, the improvement wherein said connecting member comprises:

a cylindrical stud portion having a first stud end and a second stud end, said stud portion extending through said sash arm aperture;

a cylindrical shaft connected to said second stud end, said cylindrical shaft extending through said sash support arm aperture, said cylindrical shaft being eccentric with respect to said stud portion; and a recess formed in a free end of said cylindrical shaft, said recess being designed to receive a tool to permit rotational movement of said connecting member to thereby permit change of a sash support arm pivot access.

2. The improvement of claim 1 further including a washer, said washer being mounted between said sash arm and said sash support arm.

3. The improvement of claim 1 wherein said recess formed in said free end of said cylindrical shaft is designed to receive an Allen key.

4. The improvement of claim 1 wherein said sash support arm comprises a first sash support arm portion and a second sash support arm portion, said first sash support arm portion and second sash support arm portion being connected together in an adjustable manner such that a total length of said sash support arm may be adjusted.

5. The improvement of claim 1 wherein said sash support arm is formed of a first sash support arm segment and a second sash support arm segment, the first sash support arm segment and said second sash support arm segment having ends in an overlying co-planar relationship with means for securing said first sash support arm segment and said second sash support arm segment together in an adjustable manner.

* * * * *